United States Patent [19]

Fukae et al.

[11] Patent Number: 4,757,471

[45] Date of Patent: Jul. 12, 1988

[54] ELECTROGRAPHIC PRINTER/COPIER WITH PHOTOCONDUCTIVE BELT

[75] Inventors: Kensuke Fukae, Monsey, N.Y.; Shozo Kaieda, Nagano, Japan

[73] Assignee: Kentek Information Systems, Inc., Allendale, N.J.

[21] Appl. No.: 33,456

[22] Filed: Apr. 1, 1987

[51] Int. Cl.[4] ..... G03G 21/00

[52] U.S. Cl. ..... 355/3 BE; 355/16; 355/3 SH

[58] Field of Search ..... 355/16, 3 BE, 3 DR, 355/3 SH

[56] References Cited

U.S. PATENT DOCUMENTS

| | | | |
|---|---|---|---|
| 3,603,680 | 9/1971 | Barton | 355/16 X |
| 3,697,171 | 10/1972 | Sullivan | 355/16 X |
| 3,722,992 | 3/1973 | Zwig | 355/16 X |
| 3,976,375 | 8/1976 | Kurita et al. | 355/14 R |
| 4,009,958 | 3/1977 | Kurita et al. | 355/16 |
| 4,088,403 | 5/1978 | Kingsley | 355/16 |
| 4,285,590 | 8/1981 | Silverberg | 355/16 X |
| 4,566,779 | 1/1986 | Coli et al. | 355/3 BE |
| 4,571,070 | 2/1986 | Tomita | 355/15 |
| 4,634,264 | 1/1987 | Takahashi | 355/16 |
| 4,657,369 | 4/1987 | Takeuchi | 355/3 BE |
| 4,664,507 | 5/1987 | Fukae et al. | 355/3 SH |
| 4,668,072 | 5/1987 | Yasuda | 355/3 BE |
| 4,673,956 | 6/1987 | Kobayashi | 355/3 DR |

*Primary Examiner*—R. L. Moses

*Attorney, Agent, or Firm*—Marmorek, Guttman & Rubenstein

[57] ABSTRACT

An electrographic printing apparatus comprises a photoconductive member surrounded by a charging unit, an optical print head, a developing unit, a transfer unit, a cleaning unit, and an erasing unit arranged in sequence about the photoconductive member. Paper travels along a planar path across the top of the photoconductive member and the developed image is transferred to the underside of the paper. In a preferred embodiment, the photoconductive member comprises a vertically mounted photoconductive belt. By providing a separate and independent cleaning unit, the electrographic printing apparatus is capable of producing one sheet of copy material per revolution of the belt.

6 Claims, 1 Drawing Sheet

ELECTROGRAPHIC PRINTER/COPIER WITH PHOTOCONDUCTIVE BELT

BACKGROUND OF THE INVENTION

This invention relates to an electrographic printing or copying machine having a simplified paper path. More particularly, the present invention relates to an electrographic printing or copying machine which employs a vertically mounted photoconductive belt assembly having a simplified paper path whereby an electrostatic latent image is developed on the underside of the copy sheet.

In the process of electrographic or xerographic printing, a photoconductive member is employed to record an image. The photoconductive member, which may be in the form of a belt or a drum, is charged to a substantially uniform potential to sensitize its surface. In the case of a copying machine, the charged portion of the photoconductive surface is exposed to a reflected light image of an original document to be reproduced. The light image is recorded as an electrostatic latent image on the photoconductive member corresponding to the informational areas contained on the original document.

In the case of a printer connected to a computer, a similar process is used to record information on the photoconductive member. The charged portion of the photoconductive surface is exposed to a light image, the shape of which is controlled by input signals from the computer. For example, a laser or an LED array receiving input signals from the computer illuminates the photoconductive member with a light image of a particular shape. Here too, an electrostatic latent image corresponding to the desired informational areas is recorded on the photoconductive member.

After recording the electrostatic latent image on the photoconductive member, the latent image is developed by bringing a developer material or toner into contact with it. The developer material is attracted to the electrostatic latent image and forms a powder image on the photoconductive member corresponding to the electrostatic latent image. The powder image is subsequently transferred to a sheet of recording medium, such as a sheet of paper. Thereafter, the powder image is permanently affixed to this sheet in image configuration by a variety of methods, such as by fusing.

The above-mentioned operations may be carried out by arranging a number of stations in sequence about the photoconductive member. Thus, the photoconductive member is usually surrounded in sequence by a charging station, an imaging station, a developing station, and a transfer station. A discharging station and a cleaning station are also arranged about the photoconductive member to ready it for use again.

An example of such an electrographic printing apparatus is disclosed in allowed application Ser. No. 700,813, filed Feb. 11, 1985, now U.S. Pat. No. 4,664,507. The electrographic printer/copier described in that patent application employs a photoconductive belt assembly in the form of a disposable cassette which is described and claimed in allowed application Ser. No. 718,947, filed Apr. 2, 1985, now U.S. Pat. No. 4,657,309. The printer/copier described in application Ser. No. 700,813 also employs the combined developing and cleaning unit which is the subject of allowed application Ser. No. 718,946, filed Apr. 2, 1985, now U.S. Pat. No. 4,639,116. All of these aforementioned patent applications are assigned to the present assignee and all are incorporated herein by reference.

The electrographic printer/copier described in application Ser. No. 700,813 has a simplified paper path permitting access from the top of the machine. In that electrographic printer/copier, the cassette containing the photoconductive belt is mounted vertically within the machine and a latent image is developed on the underside of the copy sheet as it passes over and comes in contact with the top of the photoconductive belt assembly.

That electrographic printing machine requires two rotations of the photoconductive belt per copy produced. It is capable of producing about 12 copies per minute. During the first rotation of the photoconductive belt, the belt is uniformly charged and a latent image is generated by means of an optical print head on the surface of the photoconductive belt. The latent image thus formed is developed by the deposition of toner from the developer/cleaning unit operating in the develop mode. The belt then enters the transfer region wherein the developed image is transferred to the underside of the paper or other copy material. In the transfer region, a transfer unit generates an electrical field which attracts the toner from the photoconductive belt to the underside of the paper. This completes the first rotation of the belt as the paper travels to a fuser unit and is discharged into the output tray.

During the next revolution of the belt, the belt is prepared for making the next copy. The main charging unit and the optional print head are disabled while an erase lamp is activated and the developer/cleaner unit is switched to the clean mode. Thus, as the belt continues to rotate following image transfer, the photoconductive belt is discharged by an erase lamp and the excess toner is removed using a conventional electrostatic process by the developer/cleaner unit. The belt is thereby readied for the next copy in the next revolution of the belt.

In order to increase the output of the above-described electrographic printer/copier, it is desirable to modify the machine by making it a "one-pass" device. That is, it would be desirable for the electrographic printer/copier to require only a single rotation of the photoconductive belt per copy produced. In this way, the output of the machine would be doubled.

SUMMARY OF THE INVENTION

This object is achieved by providing an electrographic printing apparatus similar in construction to that disclosed in allowed application Ser. No. 700,813, filed Feb. 11, 1985, but which has a separate and independent cleaning unit located immediately after the transfer station. Thus, an electrographic printing apparatus of the present invention comprises a housing, a lid for covering the top of the housing, a source of copy material and an output tray for receiving the copy material after it is imprinted. The printing apparatus also includes a photoconductive member about which the following units are arranged in sequence: a charging unit for uniformly charging the photoconductive member, an optical print head for discharging selected portions of the photoconductive member so as to form a latent electrostatic image thereon, a developer unit for developing the latent electrostatic image, a transfer unit for transferring the developed electrostatic image to the paper or other copier material, a separate cleaning unit for removing residual developer particles from the photoconductive member, and an erasing lamp for uniformly discharging the photoconductive element to ready it for making the next copy.

As in the printer/copier of application Ser. No. 700,813, the copier material travels along a substantially planar paper path near the top of the housing so that access to the paper path may be achieved by lifting the lid. The photoconductive member is located below the planar paper path and comes into contact with the underside of the copier material in a transfer zone located in the planar path in order to transfer the powder image to the underside of the copier material.

Desirably, the photoconductive member comprises the photoconductive belt assembly in the form of a disposable cassette which is disclosed and claimed in the previously mentioned allowed application Ser. No. 718,947, filed Apr. 2, 1985. This photoconductive belt assembly is mounted vertically in the electrographic printer/copier. It includes a sheet guiding structure at the top of its frame which defines a horizontal transfer zone of very short length below the top of the housing.

While electrographic printer/copier machines have been described which include separate and independent cleaning units, see for example, U.S. Pat. No. 3,976,375 (Kurita, et al.), the prior art does not disclose the particular structure and arrangement of units described above.

DETAILED DESCRIPTION OF THE PREFERRED EMBODIMENT

Figure 1:
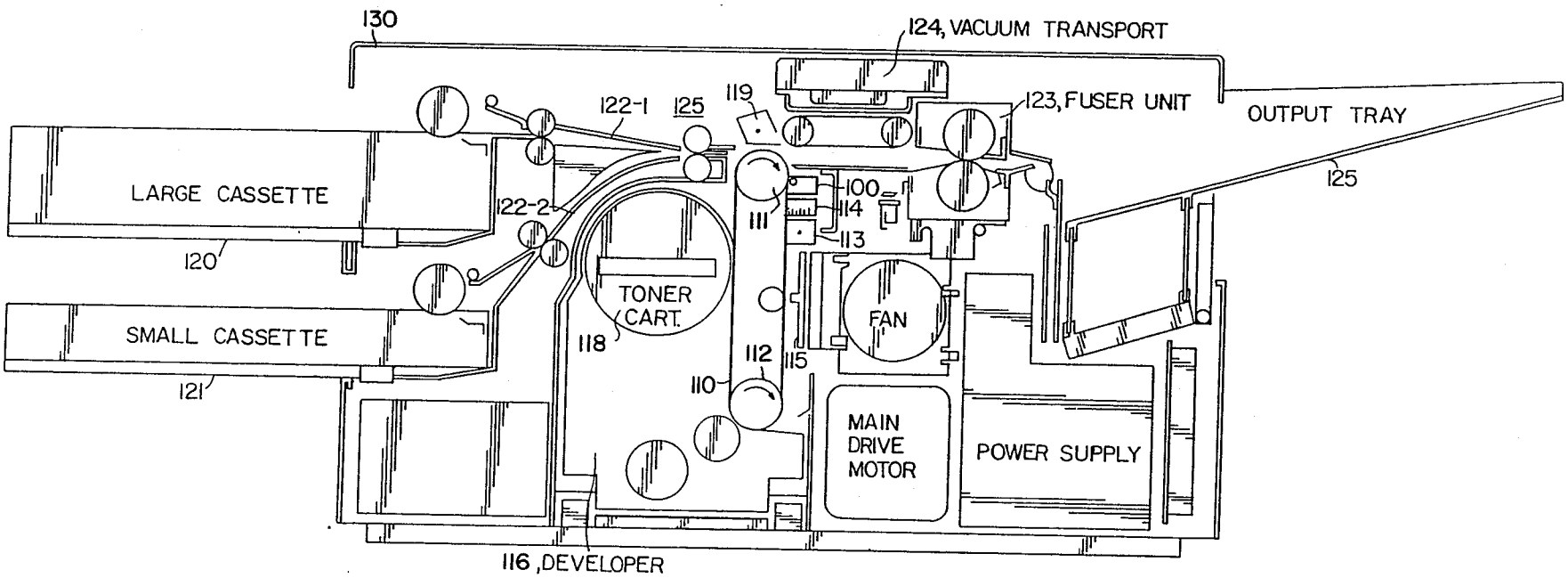
FIG. 1 is a schematic diagram of an electrographic printer/copier in accordance with an illustrative embodiment of the present invention.

FIG. 1 is a block diagram showing the basic components of an electrophotographic printer in accordance with one aspect of the present invention. Such printers typically include a photoconductive member which, in the illustrative embodiment, is a belt 110. The latter is rotated clockwise, by means of rollers 111 and 112. Located along the right side of the belt, as viewed in FIG. 1, are a cleaning unit 100, erase lamps 114, a main charger 113, and an optical print head 115. On the left side of the belt is the developer unit 116. This unit contains a toner cartridge 118 for convenient handling. Located at the top of the belt path, is a transfer unit 119, which unit creates an electric field to attract toner from the photoconductive belt 110 onto the underside of sheets of paper passing through the image transfer region 125.

The copy material, e.g., paper, is derived from either of two convenient paper handling cassettes 120 or 121. The paper is directed along either of two paper paths 122-1 or 122-2 to the image transfer region 125 located between the upper roller 111 and the transfer unit 119. From the image transfer region 125, the paper is then transported to a fuser unit 123 by means of a vacuum transport unit 124, and finally ejected into an output tray assembly 125.

The operation of this printer involves only a single rotation of belt 110 per copy produced. During this rotation, the belt is uniformly charged as it passes main charger 113. A latent image is generated by means of optical print head 115, which can be either a laser or an LED array. The optical print head serves to discharge selected portions of the uniformly charged photoconductive belt 110 as it moves past the optical print head. The latent image thus formed is then developed by the deposition of toner particles from the developer unit 116. Illustratively, the toner is deposited only on the discharged portions of the photoconductive belt 110. The belt then enters the transfer region 125 wherein the developed image is transferred to the underside of the paper or other copy material. In the transfer region 125 the transfer unit 19 serves to form an electric field which attracts the toner from the photoconductive belt to the underside of the paper.

Having transferred the developed image to the underside of the paper or other sheet material, the photoconductive belt must then be readied for the next copy. The photoconductive belt 110 continuing in the same revolution is cleaned by means of cleaning unit 100. The erase lamps 114 are activated to uniformly discharge the photoconductive belt. Thus, as the belt rotates following image transfer, the excess toner is removed by the cleaning unit 100 and the belt is discharged by erase lamps 114. The belt is thereby readied to be charged again by main charger 113 for production of the next copy.

As noted hereinabove, it is a feature of the present invention that the copy is formed along the underside of the paper. This is accomplished by locating the photoconductive belt 110 below the paper path. Thus, in the illustrative embodiment of FIG. 1, the transfer region is located above roller 111 and the paper enters the region with its lower surface in contact with belt 110.

To avoid smudging the copy following image transfer, the printed paper is transported to the conventional fuser unit 123 by means of a vacuum transfer unit 124 whose only contact is with the upper, unprinted, side of the paper. The fuser unit 123 serves to fuse the toner to the paper by way of applying heat to the paper.

After leaving the fuser unit 123, the printed copy enters the output tray 125 with its printed side down. An advantage of this arrangement is that the printed copies are automatically collated. An additional advantage of placing the photoconductive belt 110 below the paper path is that the paper path is then readily accessible, thus making it possible to clear paper jams more easily. As can be seen in FIG. 1, the paper path extends along the top of the printer and is accessible simply by lifting lid 130 of the machine.

The cleaning unit 100 may comprise any of a number of conventional devices which have been used to remove residual toner particles from photoconductive members. Cleaning unit 100 may comprise, for example, a cleaning brush or a scraper blade. Preferably, cleaning unit 100 comprises an electrostatically charged cleaning device. Such devices are maintained at a suitable biasing voltage as a result of which they are able to attract toner particles from the photoconductive member. Most preferably, cleaning unit 100 comprises one of the electrostatic cleaning devices described in applications entitled "DEVICE FOR REMOVING RESIDUAL DEVELOPER PARTICLES FROM A PHOTOCONDUCTIVE MEMBER" or "TONER CLEANING UNIT" both of which are being filed concurrently herewith. These applications are assigned to the common assignee of the present application and are incorporated herein by reference. These applications are directed to cleaning units which can be suitably mounted on a photoconductive belt assembly such as that illustrated herein.

As a result of the use of a separate and independent cleaning unit, the electrographic printer/copier described in application Ser. No. 700,813, can be converted from a "two pass" machine to a "one pass" machine, i.e., one copy is produced per revolution of the photoconductive belt. Thus, the output of the machine is effectively doubled from about twelve pages per minute to about twenty-four pages per minute.

Suitable adaptations may be made in the above apparatus in order to provide a printing apparatus with duplexing abilities. By means of these adaptations, first one side of the copier material passes by the photoconductive belt and then the other side of the copier material passes by the photoconductive belt so that powder images are transferred to both sides of the copier material. With the use of a separate and independent cleaning device only one revolution of the photoconductive belt is required per imprinted side of copier material. Thus, the machine with duplexing is capable of producing 24 sides per minute.

Cleaning unit 100 is enclosed within a housing of its own. Desirably, it is mounted on the photoconductive belt assembly as illustrated. Cleaning unit 100 can be replaced as a separate unit in the event it malfunctions. However, this may require realignment of the parts. In the normal course of events, it is expected that it will be disposed of along with the remainder of the disposable cassette.

While the invention has been described by reference to a specific embodiment, this was for purposes of illustration only and should not be construed to limit the spirit or the scope of the invention.

We claim:

1. An electrographic printing apparatus for producing hard copies of information to be recorded, comprising a housing open on top, a lid for covering the top of the housing, said lid being openable, a source of copy material and an output tray for receiving said copy material after it is imprinted, a copy material path along which said copy material travels between said source and said output tray, said copy material path being substantially contained in a single plane located in said housing near the top thereof so that access to said copy material path may be achieved by lifting said lid, a disposable cassette including a rotatable photo conductive belt slidably and removably mounted in said housing, said cassette being vertically aligned in said housing and being removable by sliding it in a vertical direction, said cassette being located below said planar copy material path and said photoconductive belt coming into contact with the underside of said copy material in a transfer zone located in said planar copy material path to transfer a latent electrostatic image of the information to be imprinted onto the underside of said copy material, said copy material being in contact with said photoconductive belt substantially only in said transfer zone, a charging unit, a selective discharging unit, a developing unit, a transfer unit, a cleaning unit, and an erasing unit arranged in sequence about said photoconductive belt, said cleaning unit being mounted on said cassette for removal therewith, said cleaning unit removing residual toner from said photoconductive belt upon each revolution of said photoconductive belt, said electrographic printing apparatus producing one imprinted side of recorded material per revolution of said photoconductive belt.

2. The eleotrographic printing apparatus of claim 1 wherein said cleaning unit is enclosed within a cleaning unit housing.

3. The electrographic printing apparatus of claim 1 wherein said selective discharging unit comprises an optical print head.

4. The electrographic printing apparatus of claim 1 wherein said cassette remains in said housing when said lid is lifted.

5. An electrographic printing apparatus for producing hard copies of information to be recorded, comprising a housing open on top, a lid for covering the top of the housing, said lid being openable, a source of copy material and an output tray for receiving said copy material after it is imprinted, a copy material path along which said copy material travels between said source and said output tray, said copy material path being substantially contained in a single plane located in said housing near the top thereof so that access to said copy material path may be achieved by lifting said lid, a disposable cassette including a rotatable photoconductive belt slidably and removably mounted in said housing, said cassette being vertically aligned in said housing and being removable by sliding it in a vertical direction, said cassette being located below said planar copy material path and said photoconductive belt coming into contact with the underside of said copy material in a transfer zone located in said planar copy material path to transfer a latent electrostatic image of the information to be imprinted onto the underside of said copy material, said copy material being in contact with said photoconductive belt substantially only in said transfer zone, a charging unit, a selective discharging unit, a developing unit, a transfer unit, a cleaning unit, and an erasing unit arranged in sequence about said photoconductive belt, and vacuum transport means attached to said lid above said copy material path for transporting said copy material after it has been imprinted, said vacuum transport means being lifted with said lid, said cleaning unit being mounted on said cassette for removal therewith, said cleaning unit removing residual toner from said photoconductive belt upon each revolution of said photoconductive belt, said electrographic printing apparatus producing one imprinted side of recorded material per revolution of said photoconductive belt.

6. The electrographic printing apparatus of claim 5 wherein said cassette remains in said housing when said lid is lifted.

* * * * *